US010480265B1

(12) United States Patent
Keast

(10) Patent No.: US 10,480,265 B1
(45) Date of Patent: Nov. 19, 2019

(54) COMBINATION HYDRAULIC CATWALK AND POWER SWIVEL

(71) Applicant: Larry G. Keast, Houston, TX (US)

(72) Inventor: Larry G. Keast, Houston, TX (US)

( * ) Notice: Subject to any disclaimer, the term of this patent is extended or adjusted under 35 U.S.C. 154(b) by 0 days.

(21) Appl. No.: 15/668,257

(22) Filed: Aug. 3, 2017

(51) Int. Cl.
*E21B 19/15* (2006.01)
*E21B 19/14* (2006.01)
*E21B 19/20* (2006.01)
*E21B 19/16* (2006.01)

(52) U.S. Cl.
CPC ..... *E21B 19/155* (2013.01); *E21B 19/165* (2013.01); *E21B 19/20* (2013.01)

(58) Field of Classification Search
CPC ..... E21B 19/155; E21B 3/02; E21B 19/06; E21B 19/16; E21B 19/20
See application file for complete search history.

(56) References Cited

U.S. PATENT DOCUMENTS 3,766,991 A * 10/1973 Brown ..... E21B 3/02 173/164
4,582,146 A * 4/1986 Becker ..... E21B 19/20 173/149
4,890,681 A * 1/1990 Skelly ..... E21B 3/02 173/218
6,832,658 B2 * 12/2004 Keast ..... E21B 3/02 166/77.52
6,877,942 B2 * 4/2005 Eastcott ..... B60P 3/00 414/22.54
7,090,035 B2 * 8/2006 Lesko ..... E21B 19/20 175/113
7,163,367 B2 * 1/2007 Handley ..... E21B 19/155 405/166
7,568,533 B2 * 8/2009 Felt ..... E21B 19/155 175/52
8,075,036 B2 * 12/2011 Hancock, Sr. ..... B60P 3/14 296/26.08
8,807,208 B1 * 8/2014 Keast ..... E21B 19/06 166/75.11
8,840,352 B2 * 9/2014 Taggart ..... E21B 19/155 414/22.54
8,845,260 B2 * 9/2014 Gerber ..... E21B 19/15 414/22.54
9,388,647 B2 * 7/2016 Dahmes ..... E21B 19/14
9,464,491 B2 * 10/2016 Nikiforuk ..... E21B 19/06
9,725,970 B1 * 8/2017 Williams ..... E21B 19/14
2015/0008038 A1 * 1/2015 Folk ..... E21B 19/155 175/52
2015/0259984 A1 * 9/2015 Taggart ..... E21B 7/023 175/57

(Continued)

*Primary Examiner* — Gregory W Adams
(74) *Attorney, Agent, or Firm* — Rao DeBoer Osterrieder, PLLC; John M. DeBoer

(57) ABSTRACT

A combination hydraulic pipe handler and power swivel for providing services normally requiring two machines, two hydraulic systems, two engines, two spaces at a rig site, and two costs to the user. Now only one machine is required. The combination hydraulic pipe handler and power swivel can pick up tubulars, present tubulars safely to the rig floor at an adjustable angle, and provide a tilting power swivel which tilts to the same adjustable angle allowing the rig operator to threadably engage tubulars and lift the tubulars to vertical. Tailing of tubulars with a rope and manpower is not required, thus the operation is much safer than normal.

5 Claims, 7 Drawing Sheets

(56) References Cited

U.S. PATENT DOCUMENTS

2016/0060982 A1* 3/2016 Layden ..... E21B 19/16
166/380
2016/0362037 A1* 12/2016 Ellement ..... B60P 3/125

* cited by examiner

COMBINATION HYDRAULIC CATWALK AND POWER SWIVEL

FIELD

The present disclosure generally relates to a mobile unit with a combination hydraulic catwalk and power swivel.

BACKGROUND

In the oil and gas industry, and specifically near drilling or servicing rigs, tubular members are often stored horizontally on pipe racks. Such pipe racks are relatively near the ground, and substantially below the rig floor. Therefore, such tubulars must be transported to the rig floor joint by joint for use in drilling or servicing operations.

Commonly, automated pipe handling systems are utilized to transport tubulars from a pipe rack and present the tubular at the proper elevation and angle for convenient and safe use by rig floor personnel. Such pipe handling systems are commonly available from rental companies or from well servicing or drilling companies.

While many variations of such pipe handling systems exist, no mobile system currently exists which can allow for coordinating the movement of a tubular to a rig floor, threadably engaging the tubular with a power swivel, and for lifting the tubular to a vertical position.

Currently, separate pipe handling and power swivel systems must be bought or rented, requiring two hauls to the rig site and taking up two equipment spaces at the rig site.

A need exists, therefore, for a pipe handling system in conjunction with a power swivel to provide a compact and space saving solution, a rapid and safe pipe handling solution, a rapid and safe power swivel attachment solution, and a simple and reliable solution with minimal downtime.

The present disclosure meets these needs.

BRIEF DESCRIPTION OF THE DRAWINGS

The detailed description will be better understood in conjunction with the accompanying drawings as follows.

Figure 1:
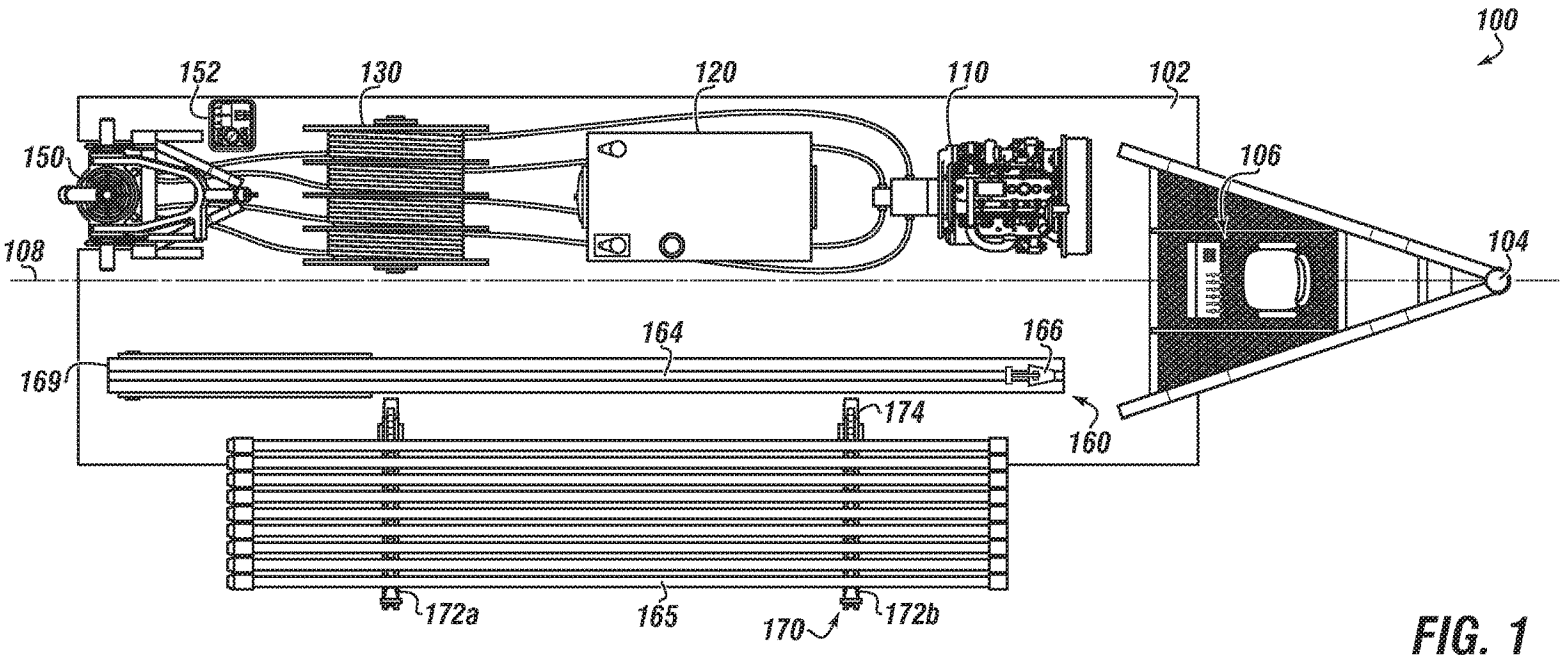
FIG. 1 shows a top view of a combination hydraulic catwalk and power swivel according to one or more embodiments.

The embodiments of the present disclosure are detailed below with reference to the listed Figures.

DETAILED DESCRIPTION OF THE EMBODIMENTS

Before explaining the present invention in detail, it is to be understood that the invention is not limited to the specifics of particular embodiments as described and that it can be practiced, constructed, or carried out in various ways.

While embodiments of the disclosure have been shown and described, modifications thereof can be made by one skilled in the art without departing from the spirit and teachings of the disclosure. The embodiments described herein are exemplary only, and are not intended to be limiting.

Specific structural and functional details disclosed herein are not to be interpreted as limiting, but merely as a basis of the claims and as a representative basis for teaching persons having ordinary skill in the art to variously employ the present invention. Many variations and modifications of embodiments disclosed herein are possible and are within the scope of the present disclosure.

Where numerical ranges or limitations are expressly stated, such express ranges or limitations should be understood to include iterative ranges or limitations of like magnitude falling within the expressly stated ranges or limitations.

The use of the word "a" or "an" when used in conjunction with the term "comprising" in the claims and/or the specification may mean "one," but it is also consistent with the meaning of "one or more," "at least one," and "one or more than one."

The use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, and the like.

Accordingly, the scope of protection is not limited by the description herein, but is only limited by the claims which follow, encompassing all equivalents of the subject matter of the claims. Each and every claim is hereby incorporated into the specification as an embodiment of the present disclosure. Thus, the claims are a further description and are an addition to the embodiments of the present disclosure.

The inclusion or discussion of a reference is not an admission that it is prior art to the present disclosure, especially any reference that may have a publication date after the priority date of this application. The disclosures of all patents, patent applications, and publications cited herein are hereby incorporated by reference, to the extent they provide background knowledge; or exemplary, procedural or other details supplementary to those set forth herein.

The embodiments of the present disclosure generally relate to a combination hydraulic pipe handler and power swivel.

The equipment of the combination hydraulic pipe handler and power swivel may be mounted on a platform, which can be in the form of a trailer or a skid.

The combination hydraulic pipe handler and power swivel can have a power swivel, a pipe loader, a pipe handler, an operator station for controlling the hydraulic pipe handler, and an operator station for controlling the power swivel. In embodiments, the power swivel can have a tilt function.

The combination hydraulic pipe handler and power swivel can provide the pipe handling mechanism in conjunction with the power swivel on a single platform. This requires only a single footprint near the rig, which saves valuable space.

Automation of repetitive tasks can provide rapid and safe presentation of tubulars to the rig floor which minimizes the need for personnel to have "hands on" equipment or tubulars, thus increasing the safety of operations.

Further, the flexibility of being able to use either the power swivel or the pipe handler, or both in conjunction can improve equipment utilization rates, reduce overall cost, and increase profitability of rental companies.

The platform can be in the form of a trailer or a skid. A trailer configured to be towed by a vehicle can have wheels, outriggers, and a towing hitch. The outriggers can be configured to be retracted or extended as necessary. When the platform is positioned as desired, the outriggers can be extended to secure the platform in a level and substantially fixed position.

A power swivel can be provided on the platform for use on a rig. The power swivel can be mounted on a rack on the platform for travel to a rig site. In embodiments, the power swivel can employ a tilt mechanism.

The tilt mechanism can comprise a tilt plate and a tilt cylinder. In embodiments, the tilt plate comprises an adjustable stop. In embodiments, the tilt cylinder allows hydraulic extension and retraction. The tilt mechanism can be remotely controlled by a power swivel operator on the rig floor. The tilt mechanism can allow the rig operator to selectively tilt the power swivel to threadably engage tubulars presented at an angle to the rig floor by the pipe handler.

In embodiments, the power swivel can be in hydraulic communication with a hose reel and a pump for hydraulic fluid supply. Such a hose reel can require a maximum of four hoses, each hose being connected from a hydraulic pump to the power swivel. These hoses can include two main power hoses, one case drain hose, and one pressure hose to the tilt cylinder. This eliminates one hose from a system normally requiring five hoses. The four hoses can be efficiently extended and retracted from a simple and reliable hose reel. The tilt cylinder, like any double acting hydraulic cylinder normally requires two hoses from the hose reel but an ingenious circuit uses a hose or tube on board the power swivel in communication with a low pressure hydraulic fluid source to tilt the power swivel back to vertical.

A power swivel control panel for remotely controlling the power swivel including the tilt function can be transported on the trailer. At the rig site, the power swivel control panel can be relocated to the rig floor where the rig operator can conveniently and safely control the power swivel.

Pipe handling functions provided on the trailer unit can include the following, but is not limited to the following:

A pipe loader can be provided to raise the pipe from separate pipe racks at a low position to the machine's incoming pipe support arms.

Pipe support arms can be arranged to support the incoming pipe on a slight downhill toward a pipe handler trough.

A pipe indexing mechanism can be arranged to index one pipe joint at a time into the pipe handler trough while holding back the other joints.

A pipe handler trough can be arranged to elevate a joint of pipe to an adjustable height and an adjustable angle to conveniently serve the rig floor.

A movable pipe pusher or skate can be hydraulically powered to push a tubular or a joint of pipe up the trough to a convenient extension for use by rig floor personnel, where the tubular can be threadably engaged by the power swivel.

A pipe loading mechanism, or pipe loader, can be provided on the trailer unit. Various mechanisms are known to persons having ordinary skill in the art. The pipe loading mechanism can be configured to receive tubulars from a pipe rack placed adjacent to the pipe handler machine. The pipe loading mechanism can then provide tubulars one at a time to the pipe handler.

Various pipe handlers are known to persons having ordinary skill in the art. The pipe handler can comprise a catwalk and a transport mechanism. In embodiments, the catwalk can comprise a trough to receive a tubular. The catwalk can be raised to a desired angle and height for presenting a tubular to the drilling rig floor, where the tubular can be threadably engaged by the power swivel.

The present disclosure also includes a method of using a pipe handler and power swivel. The steps discussed below need not be in any specific order.

The method can include the step of providing a combination hydraulic pipe handler and power swivel proximate a drilling rig. The combination hydraulic pipe handler and power swivel can be any of the embodiments described above. The combination hydraulic pipe handler and power swivel can be towed to a rig with a vehicle and positioned as desired near pipe racks.

The method can include the step of securing the combination hydraulic pipe handler and power swivel to be substantially level and stationary with a plurality of outriggers. Outriggers can be configured to be extended or retracted as needed by various means as known to persons having ordinary skill in the art.

The method can include the step of raising the power swivel for engagement by the traveling block of the rig. One method can include using a lifting device, such as a forklift, to raise the power swivel to the drilling rig floor for attachment to the traveling block.

In other embodiments, a winch and cable can be provided on the combination hydraulic pipe handler and power swivel and attached to the power swivel. Another winch and cable on the rig can also be attached to the power swivel. The two winches can be used in conjunction to transport the power swivel to the rig floor safely.

In other embodiments, the power swivel can be attached to the end of the catwalk of the pipe handler and transported by the pipe handler to the rig floor for attachment to the traveling block.

The method can include the step of delivering a tubular to the pipe handler with the pipe loader. A typical pipe loader can receive tubulars from the pipe rack. In embodiments, the pipe loader can have a sight downgrade toward the pipe handler to allow tubulars to be gravity fed. In embodiments, a pipe kicker can provide tubulars one at a time to the pipe handler while holding back the rest of the tubulars.

In embodiments, the pipe handler can have a trough for receiving the tubular.

The method can include the step of presenting the tubular to the rig floor using the pipe handler. The pipe handler can raise the catwalk/trough and push the tubular upward along the catwalk/trough until the tubular is presented at a desired angle, a desired height, and a desired extension at the rig floor. Various mechanisms for raising catwalks to adjustable angles and heights, and for pushing tubulars are known to persons having ordinary skill in the art.

The method can include the step of threadably engaging the tubular with the power swivel. Upon presentation of the tubular, the power swivel can be used to threadably engage the tubular and lift it safely and rapidly to a vertical position, ready for drilling.

Turning now to the Figures, FIG. 1 depicts a top view of the combination hydraulic catwalk and power swivel according to one or more embodiments.

The combination hydraulic catwalk and power swivel 100 can have a platform 102 with various components attached for transport. The platform 102 can be a trailer or a skid system configured to be towed or otherwise transported to a site for use. The platform 102 can have a tow hitch 104 attached for transport. In embodiments, the platform can have an operator station 106 for operating a pipe handling system 160.

The combination hydraulic catwalk and power swivel 100 can have a power swivel 150 and associated components located on one side of a center line 108 of the platform 102. Associated components can include a hose reel 130, a hydraulic fluid tank 120, and a pump and engine 110. In embodiments, a power swivel operator station 152 can be detachably secured to the platform 102. The power swivel operator station 152 can be placed adjacent a rig operator station to allow a rig operator to control the power swivel 150.

A pipe handler 160 and a pipe loader 170 can be secured to the platform 102 opposite centerline 108 from the power swivel 150 and associated components. In embodiments, the pipe loader 170 can have pipe support arms 172*a*,172*b* that extend outward from the platform 102. In embodiments, the pipe support arms 172*a*, 172*b* can have a slight grade to allow tubulars 165 to roll toward a trough 164. The pipe loader 170 can also have a pipe indexing mechanism 174 to index one tubular 165 at a time into the trough 164.

The trough 164 can be a v-shaped structure to center tubulars 165. A pusher or skate 166 can push the tubular, or a portion of the trough 164 in order to present tubulars 165 to the drilling rig floor.

The pipe handler 160 can have a mechanism to a lift trough end 169 to present the tubular 165 to the drilling rig. In embodiments, pipe handler 160 can also comprise a mechanism to lift the trough end 169 in order to adjust the angle of presentation of the tubular 165.

When presented to the drilling rig floor, the tubular 165 can be threadably engaged by the power swivel 150 and lifted off the trough 164 to a vertical position.

Figure 2A:
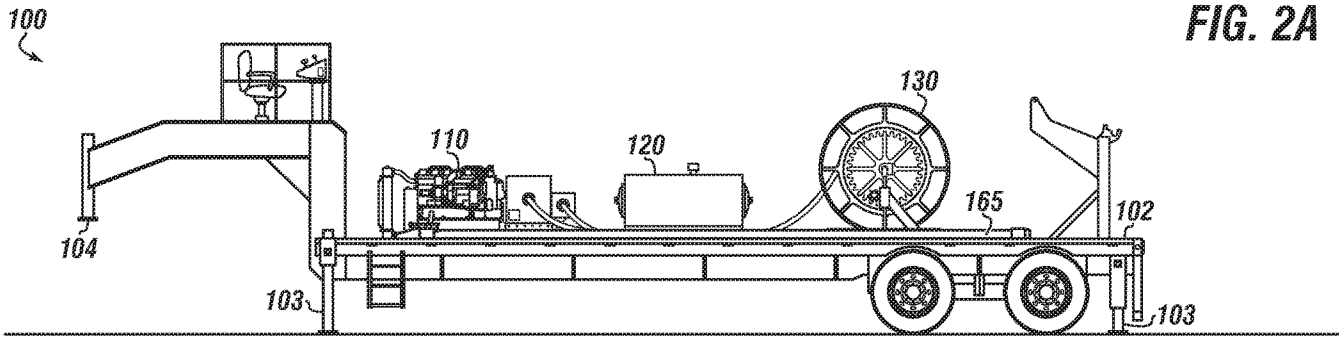
FIG. 2A depicts a side view of the combination hydraulic catwalk and power swivel according to one or more embodiments.

FIG. 2A depicts a side view of the combination hydraulic catwalk and power swivel according to one or more embodiments.

The platform 102 can have one or more outriggers 103 to secure the platform 102 in a substantially immovable fashion.

Figure 2B:
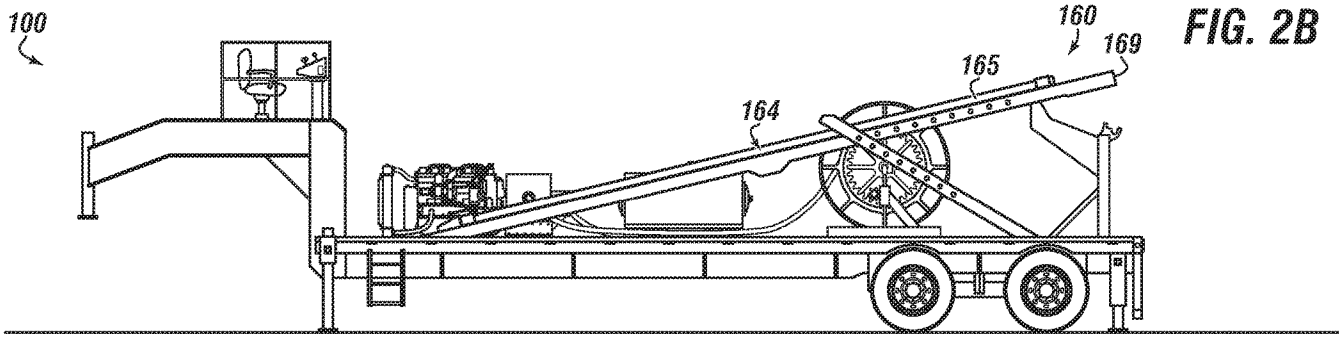
FIG. 2B depicts a side view of the combination hydraulic catwalk and power swivel with the hydraulic catwalk partially raised according to one or more embodiments.

FIG. 2B depicts a side view of the combination hydraulic catwalk and power swivel with the hydraulic catwalk partially raised according to one or more embodiments.

Shown here is the trough 164 with the trough end 169 partially raised. In embodiments, the other end of the trough 164 can also be raised to adjust presentation angle of tubular 165.

Figure 2C:
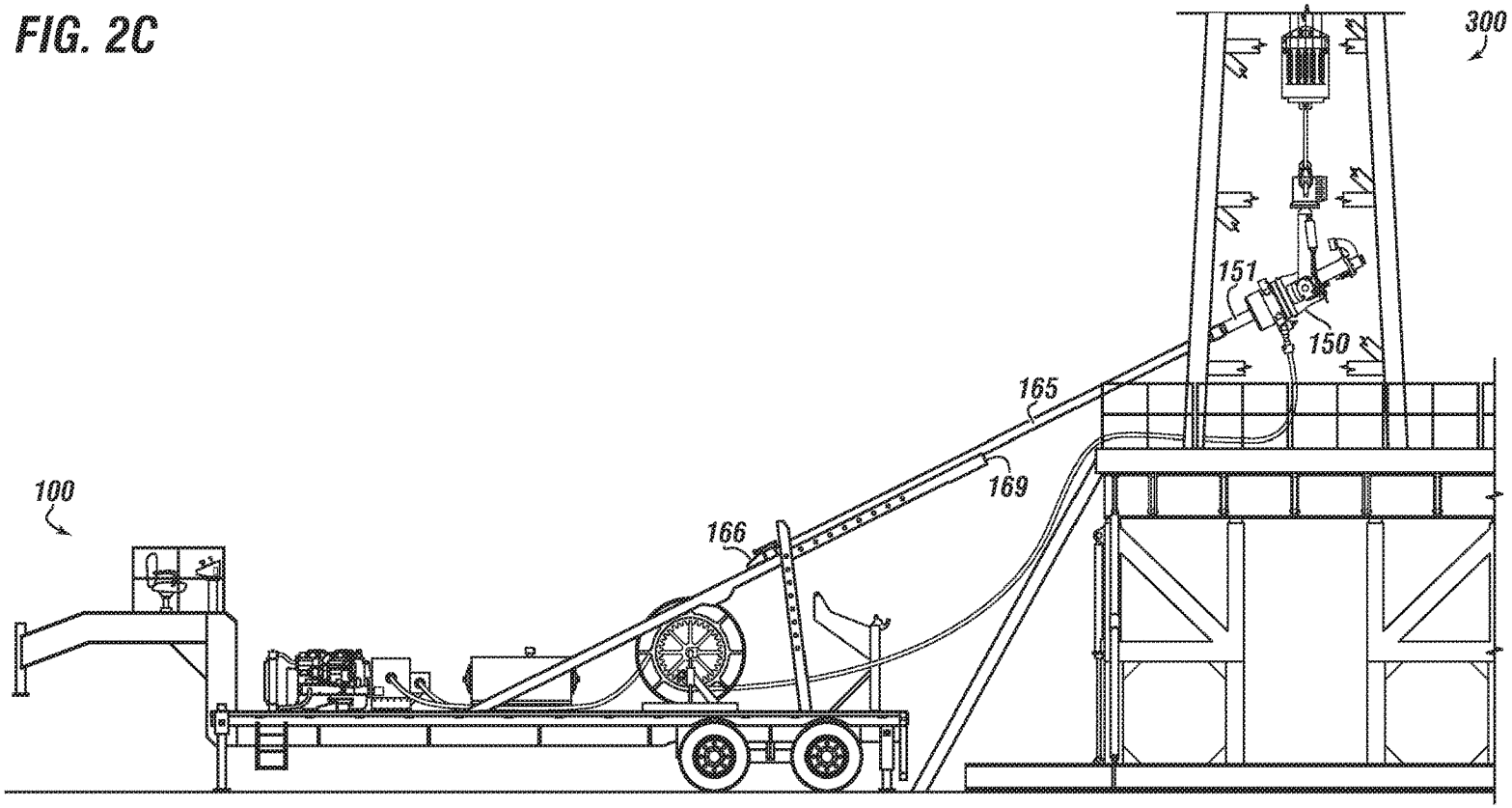
FIG. 2C depicts a side view of the combination hydraulic catwalk and power swivel with the hydraulic catwalk presenting a tubular to a platform according to one or more embodiments.

FIG. 2C depicts a side view of the combination hydraulic catwalk and power swivel with the hydraulic catwalk presenting a tubular to a platform according to one or more embodiments.

Shown here is the power swivel 150 operatively attached to a traveling block of a rig 300. Trough end 169 of the trough 164 has been raised to a desired angle. The pusher or skate 166 can extend the tubular 165 and present it to the rig 300. The power swivel 150 can have a stem 151 for threadably engaging the tubular 165. The traveling block of the rig 300 can then be raised to lift the tubular 165.

Figure 3:
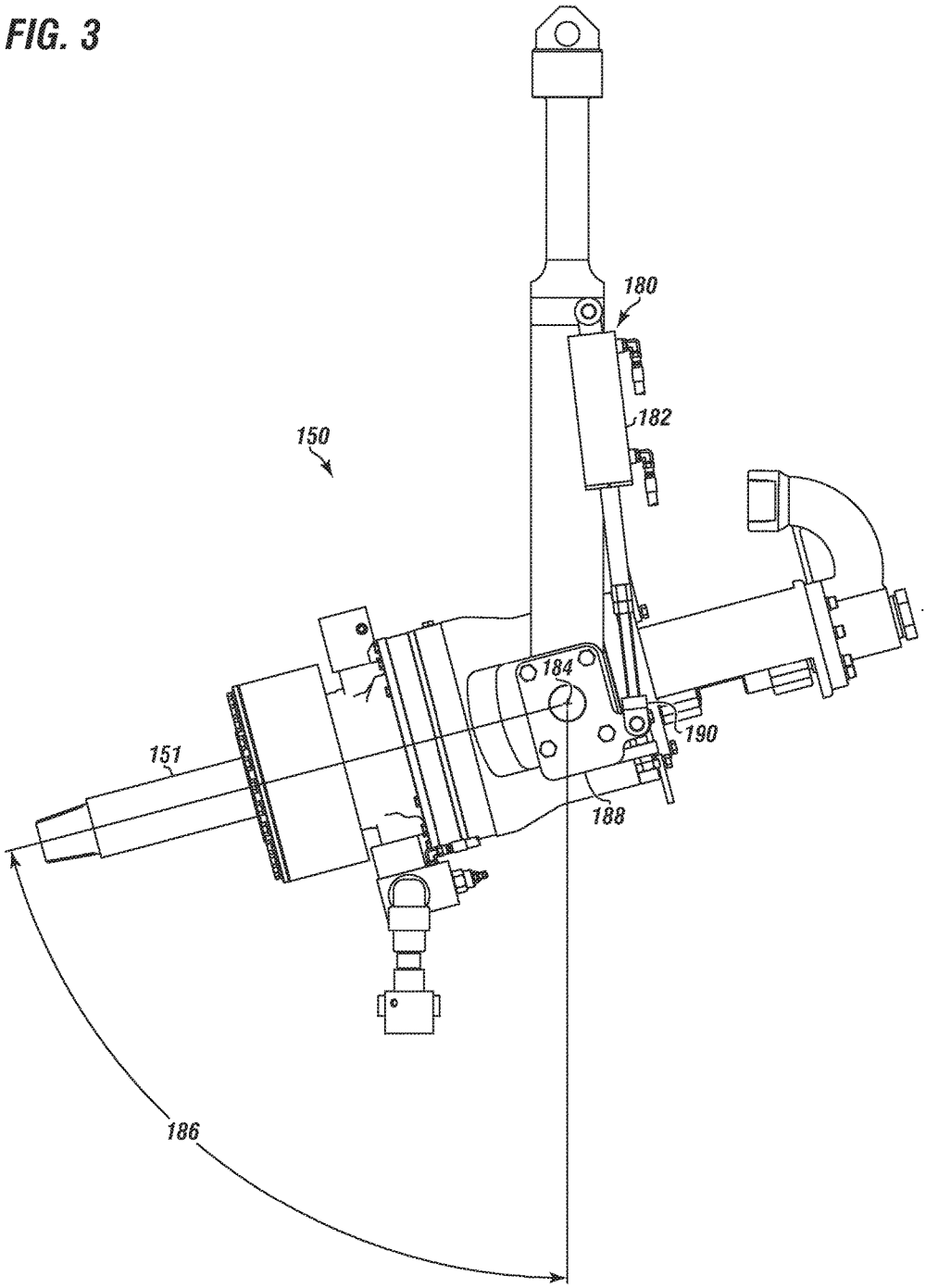
FIG. 3 depicts a side view of the power swivel tilted away from a substantially vertical position according to one or more embodiments.

FIG. 3 depicts a side view of the power swivel tilted away from a substantially vertical position according to one or more embodiments.

In embodiments, a tilt cylinder assembly 180 extends a cylinder 182, the power swivel 150 can tilt away from a substantially vertical position and can be tilted up to a full extension of the cylinder. When the cylinder retracts, the power swivel can be rotated in an opposite direction to be repositioned at a desired angle within the range of rotation. The tilt cylinder assembly 180 can control tilting of the power swivel 150 about a center point 184 to a tilt angle 186. The full extension of the cylinder can be adjusted to control the tilt angle 186. In embodiments, the tilt angle can be a preset tilt angle.

In embodiments, a tilt plate 188 can comprise a tilt plate clevis 190, which can be used in the tilt cylinder assembly 180.

Figure 4:
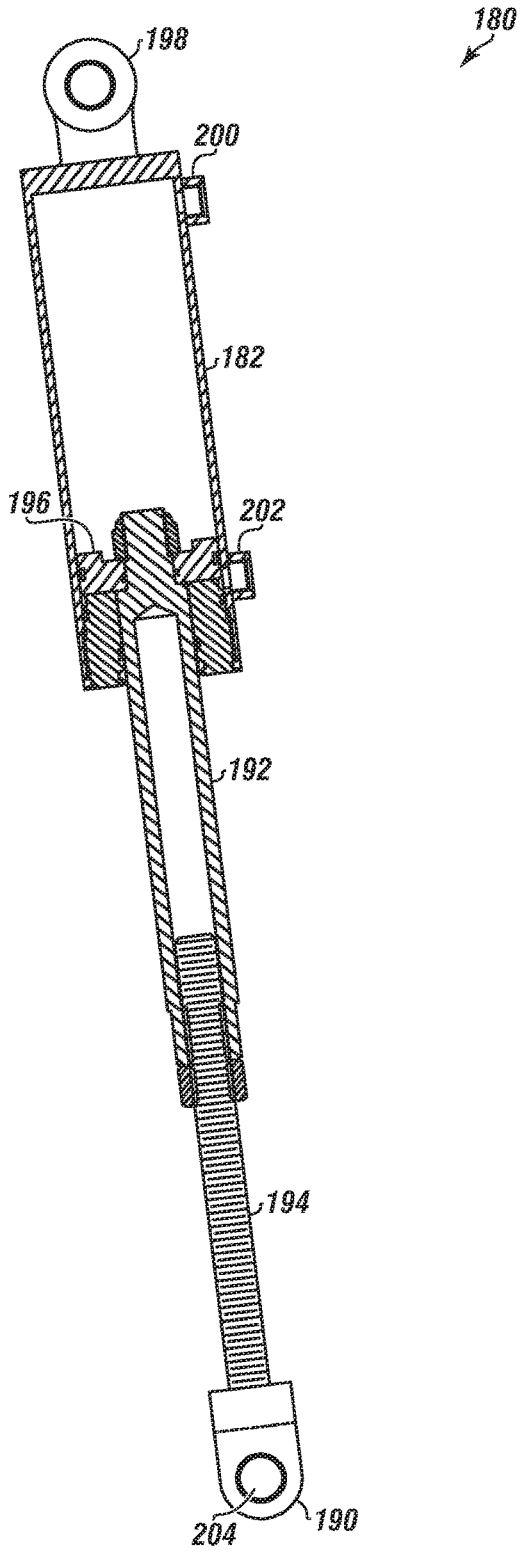
FIG. 4 depicts a tilt cylinder assembly according to one or more embodiments.

FIG. 4 depicts the tilt cylinder assembly according to one or more embodiments.

In this embodiment, one manner in which the full extension of the cylinder can be adjusted is shown. The present detail is shown in an extended orientation, when the power swivel has been angled with respect to a wellbore.

The tilt cylinder assembly 180 can have a cylinder 182, which, in embodiments, can be hydraulic. Inserted into the cylinder 182 on one end can be a hollow piston rod 192.

In embodiments, the extension of the tilt cylinder assembly can be adjusted by using a threaded rod 194 which can be threaded inside of the hollow piston rod 192, which can be extended and retracted by the cylinder 182. The full rotational range can be adjusted by manipulating the extended length of a threaded rod 194.

In embodiments, the threaded rod can adjustably extend from the cylinder, in that the threaded rod can be threaded into or out of the cylinder, and so long as the threads engage the hollow piston rod, the tilt cylinder assembly can operate to tilt the power swivel.

In embodiments, the tilt cylinder assembly 180 can engage a connecting means on a side opposite the tilt plate.

The threaded rod can adjust various distances into and away from the hollow piston rod.

In embodiments, a piston 196 in the cylinder 182 can be connected to the hollow piston rod 192. The piston can be used to extend or retract the hollow piston rod.

In embodiments, a cylinder attachment 198, such as a bail attachment clevis, can connect the cylinder 182 to the connecting means.

In embodiments, the cylinder can have an extend port 200 for receiving hydraulic fluid into the body of the cylinder, allowing the hydraulic fluid to extend the hollow piston rod 192.

The cylinder can also have a retract port 202 for receiving hydraulic fluid into the body of the cylinder, allowing the hydraulic fluid to push on the piston and the hollow piston rod and retract into the body of the cylinder, in part.

In embodiments, the tilt cylinder assembly 180 can include a tilt plate clevis 190, which can be secured to the threaded rod 194, opposite the cylinder. The tilt plate clevis 190 can secure the tilt cylinder assembly 180 to the tilt plate.

A pin 204 can secure the tilt plate clevis 190 movably to the tilt plate.

In embodiments, a hydraulic remote control can be used and can contain meters and gauges for operating the power swivel on the rig. The hydraulic remote control can control power swivel tilting while keeping the operator a safe distance from the power swivel's moving components.

Figure 5A:
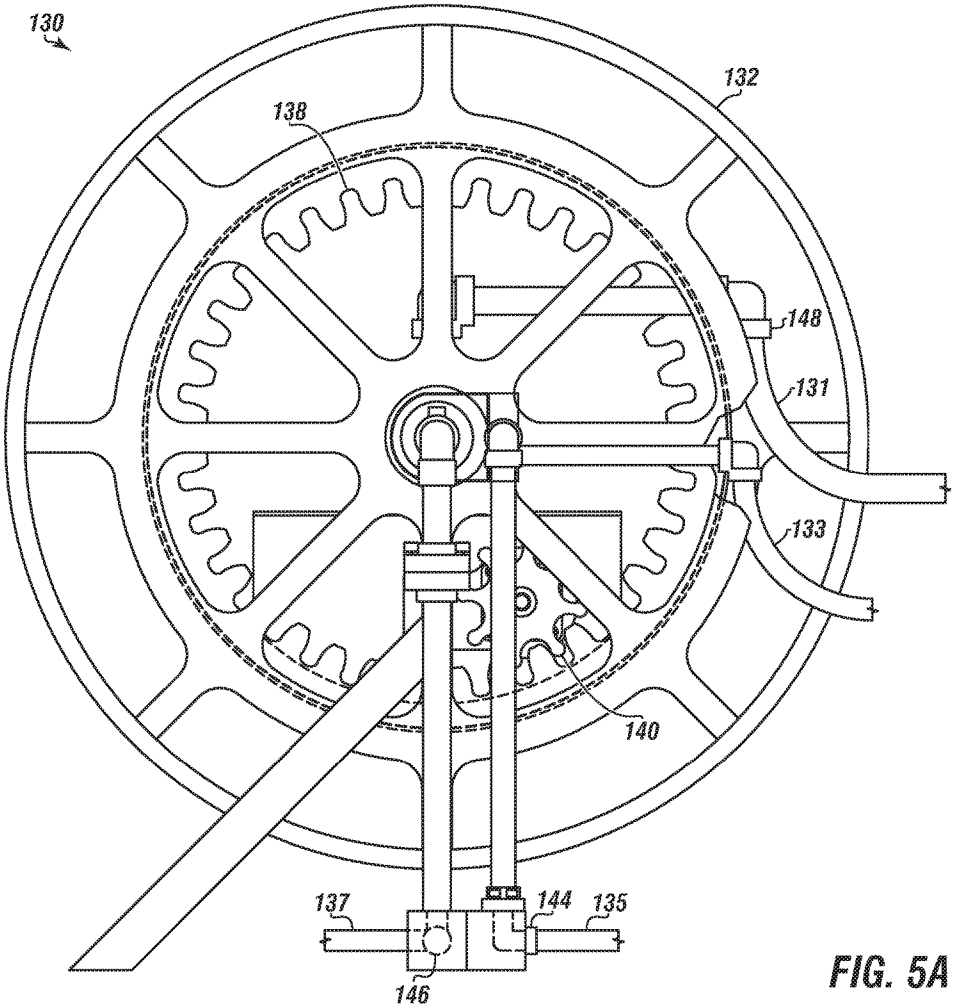
FIG. 5A depicts a hydraulic hose reel assembly according to one or more embodiments.
Figure 5B:
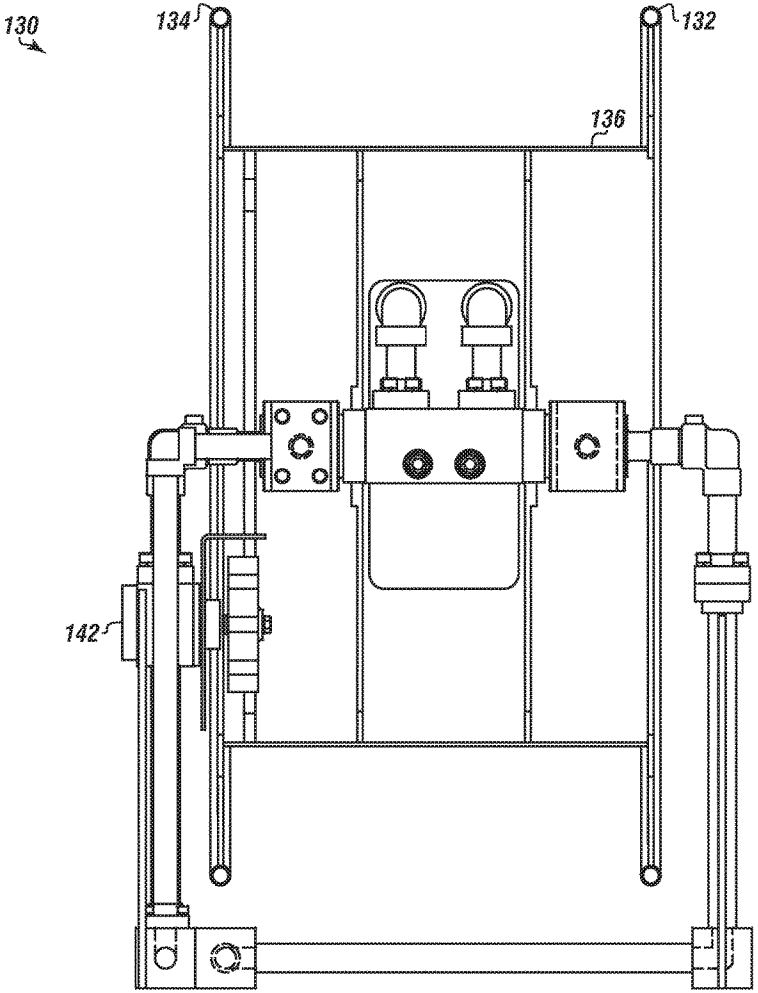
FIG. 5B depicts a hydraulic hose reel assembly according to one or more embodiments.

FIG. 5A and 5B depict a hydraulic hose reel according to one or more embodiments.

In embodiments, the hose reel 130 can be hydraulic and can have a first wheel 132, a second wheel 134, a drum 136 mounted between the wheels, a ring gear 138 secured to the drum 136, a pinion gear 140 connected to the ring gear, and a drive motor 142 connected to the pinion gear. Ports 144, 146 and 148 for flowing hydraulic fluid are shown.

In embodiments, the drive motor 142 can connect to the pinion gear 140 rotating the pinion engaging with the ring gear 138 thereby rotating the wheels and drum.

In embodiments, the hose reel assembly can have four separate fluid flow pathways. In embodiments, the power swivel utilizes a novel fluid flow path to retract to a vertical position. This reduces the number of needed hoses from five in a typical installation, to four.

The hose reel 130 can have a plurality of hoses for hydraulic fluid. The first hose 131 and second hose 133 can be in fluid communication with a rotational mechanism of the power swivel. A third hose 135 can be in fluid communication with a drain of the rotational mechanism of the power swivel. A fourth hose 137 can be in fluid communication with the power swivel, for supplying hydraulic fluid to tilt the power swivel.

While the present disclosure emphasizes the embodiments, it should be understood that within the scope of the appended claims, the invention might be practiced other than as specifically described herein.

What is claimed is:

1. A combination hydraulic pipe handler and power swivel comprising:

a platform comprising a plurality of wheels, a plurality of outriggers, and a towing hitch;

a power swivel comprising a tilt mechanism, the tilt mechanism further comprising:

a tilt cylinder assembly comprising a hydraulically controlled extension;

a tilt cylinder rod configured for setting max of tilt; and a tilt plate configured to support the tilt cylinder assembly, and setting the power swivel to a repetitive vertical position;

a pipe loader further comprising a plurality of pipe handling arms configured to allow tubulars to roll toward or away from a pipe handling mechanism centerline of the combination hydraulic pipe handler and power swivel;

a pipe handler comprising:

a catwalk or a pipe trough with a pipe handling centerline; and a transport mechanism configured to longitudinally transfer tubulars from a pipe rack centerline to a rig floor;

a hose reel comprising a maximum of four hoses for pipe handling functions;

a hydraulic pump;

an operator station for controlling the pipe loader and the pipe handler; and a second operator station for controlling the power swivel;

wherein the power swivel is in mechanical communication with the hydraulic pump and each of the four hoses on the hose reel, and wherein each of the set of hoses is configured to be in hydraulic communication with the power swivel.

2. The combination hydraulic pipe handler and power swivel of claim 1, wherein the platform is one of a skid or a trailer, and wherein the tilt cylinder rod is threaded, adjustable, and lockable.

3. The combination hydraulic pipe handler and power swivel of claim 1, wherein the tilt mechanism is controlled remotely.

4. The combination hydraulic pipe handler and power swivel of claim 1, wherein the transport mechanism comprises an indexing mechanism for indexing one tubular at a time.

5. The combination hydraulic pipe handler and power swivel of claim 1, wherein the transport mechanism comprises a hydraulically powered pusher or a skate.

* * * * *